US009303608B2

(12) United States Patent
Kaneta

(10) Patent No.: US 9,303,608 B2
(45) Date of Patent: Apr. 5, 2016

(54) FUEL INJECTOR

(71) Applicant: DENSO CORPORATION, Kariya, Aichi-pref. (JP)

(72) Inventor: Hiroki Kaneta, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/534,829

(22) Filed: Nov. 6, 2014

(65) Prior Publication Data

US 2015/0129687 A1 May 14, 2015

(30) Foreign Application Priority Data

Nov. 8, 2013 (JP) ..... 2013-232429

(51) Int. Cl.
*F02M 61/18* (2006.01)

(52) U.S. Cl.
CPC ..... *F02M 61/1833* (2013.01); *F02M 61/1806* (2013.01)

(58) Field of Classification Search
CPC ..... F02M 51/09; F02M 51/061; F02M 61/18; F02M 61/1806; F02M 61/1833; F02M 61/184; F02M 61/1846
USPC ..... 239/585.1–585.5, 601
See application file for complete search history.

(56) References Cited

U.S. PATENT DOCUMENTS

| | | | | |
|---|---|---|---|---|
| 8,191,800 | B2 * | 6/2012 | Kitagawa et al. | 239/533.12 |
| 8,919,675 | B2 * | 12/2014 | Sakata et al. | 239/533.12 |
| 2006/0226263 | A1 | 10/2006 | Holzgrefe et al. | |
| 2009/0272824 | A1 | 11/2009 | Kitagawa et al. | |
| 2011/0253812 | A1 | 10/2011 | Sakata et al. | |
| 2012/0104121 | A1 | 5/2012 | Watanabe et al. | |
| 2012/0325938 | A1 | 12/2012 | Sakata et al. | |

FOREIGN PATENT DOCUMENTS

| | | |
|---|---|---|
| JP | 07-35002 | 2/1995 |
| JP | 3888579 | 12/2006 |
| JP | 2011-074478 | 4/2011 |
| JP | 2014-194200 | 10/2014 |

OTHER PUBLICATIONS

Office Action (3 pages) dated Oct. 27, 2015, issued in corresponding Japanese Application No. 2013-232429 and English translation (4 pages).

* cited by examiner

*Primary Examiner* — Christopher Kim
(74) *Attorney, Agent, or Firm* — Nixon & Vanderhye P.C.

(57) ABSTRACT

A fuel injector has a valve nozzle defining a fuel-injection port downstream of a fuel passage. The fuel-injection port is inclined toward a nozzle periphery from a fuel-inlet to a fuel-outlet. A valve needle is capable of moving in a valve-opening direction to open the fuel-injection port so that a fuel flowing into the fuel-inlet from the nozzle periphery is injected into an internal combustion engine. The fuel-injection port has an upstream-portion defining the fuel-inlet, and a downstream-portion defining the fuel-outlet. The downstream-portion is smoothly connected to the upstream-portion at a position most close to a center of the valve nozzle, and the downstream-portion is offset toward the nozzle periphery relative to the upstream-portion, so that the upstream-portion and the downstream-portion forms a step surface therebetween. The step surface is eccentric to a center line of the upstream-portion.

6 Claims, 6 Drawing Sheets

FUEL INJECTOR

CROSS-REFERENCE TO RELATED APPLICATION

This application is based on Japanese Patent Application No. 2013-232429 filed on Nov. 8, 2013, the disclosure of which is incorporated herein by reference.

TECHNICAL FIELD

The present disclosure relates to a fuel injector that injects a fuel into an internal combustion engine.

BACKGROUND

It is well known that a fuel injector has an injection port which is inclined outwardly.

When a valve needle is moved in a valve-opening direction, the fuel is injected into an engine through a fuel-outlet of the injection port.

JP-2013-7316 A (US-2012-0325938 A1) shows a fuel injector in which the fuel is injected outward from a plurality of injection holes provided in an injection hole plate fixed to the valve seat. A seat surface of the valve seat is formed in such a way that the inner diameter thereof decreases in a direction from an upstream side to a downstream side of a flow of the fuel. The injection hole plate has a plurality of concaves at its downstream surface. The injected fuel is separated from the concaves. The fuel is spread in a combustion chamber and its atomization is improved.

However, in the above fuel injector, a center line of each concave and a center line of the injection hole cross each other. A stepped surface is formed between the injection hole and the concave. The stepped surface crosses the center line of the injection hole at acute angle. Thus, the fuel is attracted to the stepped surface. The fuel adhered on the stepped surface may be changed to the fuel deposit, which restricts the atomization of the fuel spray.

Moreover, the fuel flow direction is varied due to the concave. It is difficult to improve a directivity of the fuel spray.

SUMMARY

It is an object of the present disclosure to provide a fuel injector which can expedite an atomization of a fuel spray and can improve a directivity of the fuel spray.

According to one aspect of the present disclosure, a fuel injector has a valve nozzle and a valve needle. The valve nozzle defines a fuel-injection port downstream of a fuel passage. The fuel-injection port is inclined toward a nozzle periphery from a fuel-inlet to a fuel-outlet. The valve needle is capable of moving in a valve-opening direction to open the fuel-injection port so that a fuel flowing into the fuel-inlet from the nozzle periphery is injected into an internal combustion engine. The fuel-injection port has an upstream-portion defining the fuel-inlet, and a downstream-portion defining the fuel-outlet. The downstream-portion is smoothly connected to the upstream-portion at a position most close to a center of the valve nozzle. The downstream-portion is offset toward the nozzle periphery relative to the upstream-portion, so that the upstream-portion and the downstream-portion form a step surface therebetween. The step surface is eccentric to a center line of the upstream-portion.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereafter, an embodiment of the present invention is described.

Figure 1:
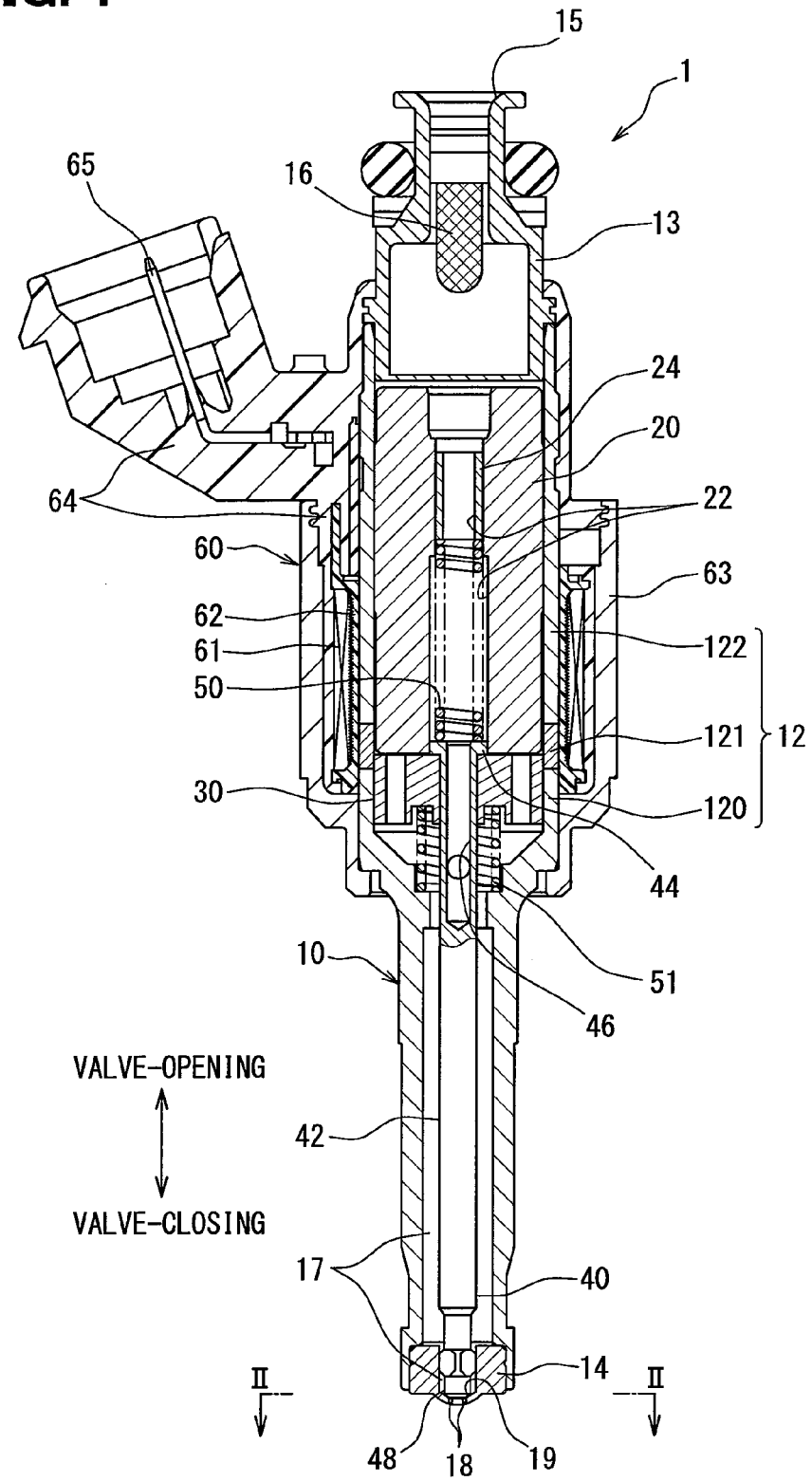
FIG. 1 is a longitudinal-sectional view showing a fuel injector.

A fuel injector 1 shown in FIG. 1 is provided to a gasoline engine so as to inject a fuel toward a combustion chamber (not shown) of the engine. Besides, the fuel injector 1 may inject a fuel into an intake passage communicating with the combustion chamber of the engine.

Basic Configuration

A basic configuration of the fuel injector 1 will be described hereinafter. The fuel injector 1 has a valve body 10, a fixed core 20, a movable core 30, a valve needle 40, springs 50, 51 and an electromagnetic driving unit 60.

The valve body 10 has a valve housing 12, a valve inlet 13, and a valve nozzle 14. The valve housing 12 is cylindrically shaped and has a first magnetic portion 120, a nonmagnetic portion 121, and a second magnetic portion 122 in its axial direction. The first and second magnetic portions 120, 121 are connected to the nonmagnetic portion 121 by laser welding. The nonmagnetic portion 121 restricts a magnetic short circuit between the first magnetic portion 120 and the second magnetic portion 122.

The valve inlet 13 is made from metallic material and is formed cylindrically. The valve inlet 13 is coaxially fixed on an inner surface of the second magnetic portion 122. The valve inlet 13 defines a fuel inlet port 15 through which the fuel is supplied from a fuel pump (not shown). A fuel filter 16 is disposed inside of the valve inlet 13 in order to filtrate the fuel flowing into the fuel inlet port 15.

The valve nozzle 14 is made from metallic material and is cup-shaped. The valve nozzle 14 is coaxially fixed on an inner surface of the first magnetic portion 120. The valve nozzle 14 and the valve housing 12 define a fuel passage 17 therein. The valve nozzle 14 has a plurality of the fuel-injection port 18 and a valve seat 19. The valve seat 19 is formed upstream of each fuel-injection port 18. The valve seat 19 has a conical surface relative to the fuel passage 17.

The fixed core 20 is made from magnetic material and is cylindrically shaped. The fixed core 20 is fixed on inner circumferences of the second magnetic portion 122 and the nonmagnetic portion 121. The fixed core 20 defines a stationary passage 22 therein, which communicates with the fuel inlet port 15. Further, the fixed core 20 has a cylindrical adjusting pipe 24 coaxially therein.

The movable core 30 is made from magnetic material and is cylindrically shaped. The movable core 30 is fixed on inner circumferences of the nonmagnetic portion 121 and the first magnetic portion 120. The movable core 30 is positioned downstream of the fixed core 20 relative to a fuel flow. The movable core 30 reciprocates in a valve-opening direction and a valve-closing direction. The valve-opening direction is an axial direction in which the movable core 30 moves close to the fixed core 20. In FIG. 1, the movable core 30 moves upward. The valve-closing direction is an axial direction in which the movable core 30 moves apart from the fixed core 20. In FIG. 1, the movable core 30 moves downward. The movable core 30 can be brought into contact with the fixed core 20 at a movable end in the valve-opening direction.

The valve needle 40 made from non-magnetic metal material is coaxially disposed inside of the nonmagnetic portion 121 the first magnetic portion 120 and the valve nozzle 14. The valve needle 40 reciprocates in the valve-opening direction and the valve-closing direction. The valve needle 40 has a shaft portion 42. The shaft portion 42 is coaxially inserted into the movable core 30 in such a manner as to move relative to the movable core 30.

The valve needle 40 has a flange portion 44 which protrudes from the shaft portion 42 at its one end. The flange portion 44 is coaxially inserted into the fixed core 20 in such a manner as to be slidably supported. The flange portion 44 can be brought into contact with the movable core 30.

The valve needle 40 has a movable passage 46 extending from the shaft portion 42 to the flange portion 44. The movable passage 46 opens at the flange portion 44, whereby the movable passage 46 communicates with the stationary passage 22. Further, the movable passage 46 opens at the shaft portion 42, whereby the movable passage 46 communicates with the fuel passage 17. Thus, without respect to a position of the valve needle 40, the fuel flows from the stationary passage 22 to the fuel passage 17 through the movable passage 46.

The valve needle 40 has a seat portion 48 which confronts to the valve seat 19. The valve needle 40 moves in the valve-opening direction so that the seat portion 48 moves apart from the valve seat 19, whereby each fuel-injection port 18 is opened to the fuel passage 17. The fuel flows from the fuel inlet port 15 to the fuel passage 17 through the stationary passage 22 and the movable passage 46. Then, the fuel is injected from each fuel-injection port 18 into the combustion chamber. Meanwhile, when the valve needle 40 moves in the valve-closing direction, the seat portion 48 sits on the valve seat 19 so that each fuel-injection port 18 is closed relative to the fuel passage 17. At this time, the fuel injection from each fuel-injection port 18 is stopped. As above, the valve needle 40 reciprocates to open and close each fuel-injection port 18.

A valve-closing spring 50 is a compression coil spring made from metallic material and is coaxially accommodated in the fixed core 20. The valve-closing spring 50 is sandwiched between the adjusting pipe 24 and the flange portion 44. Thereby, the valve-closing spring 50 biases the valve needle 40 in the valve-closing direction.

A valve-opening spring 51 is a compression coil spring made from metallic material and is coaxially accommodated in the first magnetic portion 120. The valve-opening spring 51 is sandwiched between the movable core 30 and the adjusting pipe 24 and the first magnetic portion 120. Thereby, the valve-opening spring 51 biases the movable core 30 in the valve-opening direction.

The electromagnetic driving unit 60 has a solenoid coil 61, a resin bobbin 62, a magnetic yokes 63, a connector 64, and a terminal 65. The solenoid coil 61 is wound around the resin bobbin 62. The solenoid coil 61 is coaxially disposed around the first magnetic portion 120, the second magnetic portion 122, and the nonmagnetic portion 121 through the resin bobbin 62. The cylindrical magnetic yoke 63 is coaxially disposed around the solenoid coil 61 so as to magnetically connect the first magnetic portion 120 and the second magnetic portion 122. A resin connector 64 extends outward from an opening of the magnetic yokes 63. The resin connector 64 has a metal terminal 65 that connects the solenoid coil 61 to an external circuit (not shown). An energization of the solenoid coil 61 is controllable by the external circuit.

When the solenoid coil 61 is energized, a magnetic flux is generated through the magnetic yokes 63, the first magnetic portion 120, the movable core 30, the fixed core 20, and the second magnetic portion 122. A magnetic attraction force is generated between the fixed core 20 and the movable core 30. The movable core 30 is attracted to the fixed core in the valve-opening direction. Against a restoring force of a valve-closing spring 50, the movable core 30 biases the flange portion 44 to moves in the valve-opening direction along with the valve needle 40. The seat portion 48 moves away from the valve seat 19, so that the fuel is injected from each fuel-injection port 18. At this time, the movable core 30 abuts on the fixed core 20.

When the solenoid coil 61 is deenergized, the magnetic flux is disappeared and the magnetic attraction force between the fixed core 20 and the movable core 30 is also disappeared. The valve needle 40 receives the restoring force of the valve-closing spring 50, which is larger than that of the valve-opening spring 51, through the flange portion 44. The flange portion 44 biases the movable core 30. As a result, the movable core 30 and the valve needle 40 move in the valve-closing direction and the seat portion 48 sits on the valve seat 19. The fuel injection from each fuel-injection port 18 is terminated.

Shape of Fuel-Injection Port

A shape of the fuel-injection port 18 will be described in detail hereinafter.

Figure 2:
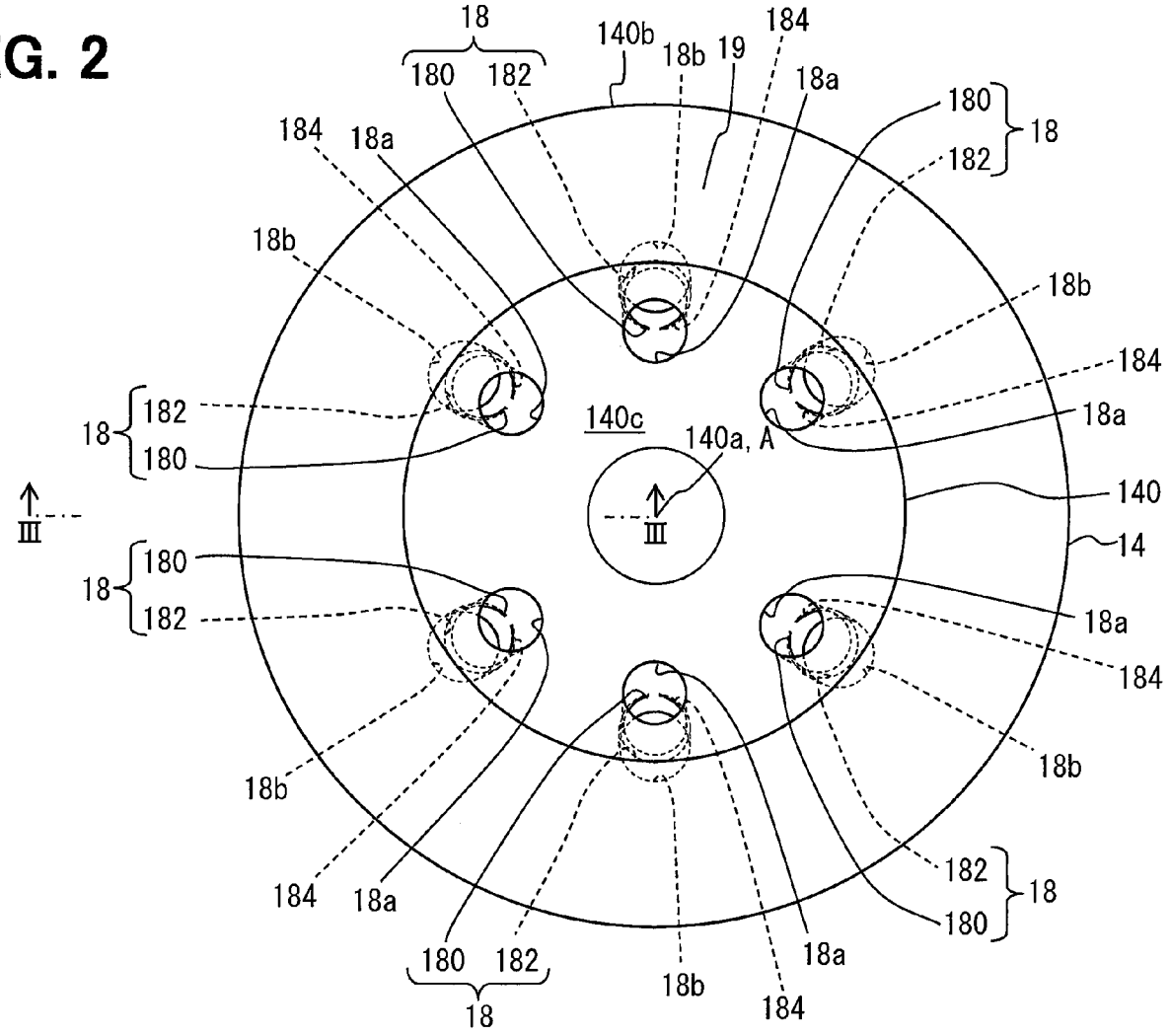
FIG. 2 is an enlarged cross-sectional view taken along a line II-II in FIG. 1.
Figure 3:
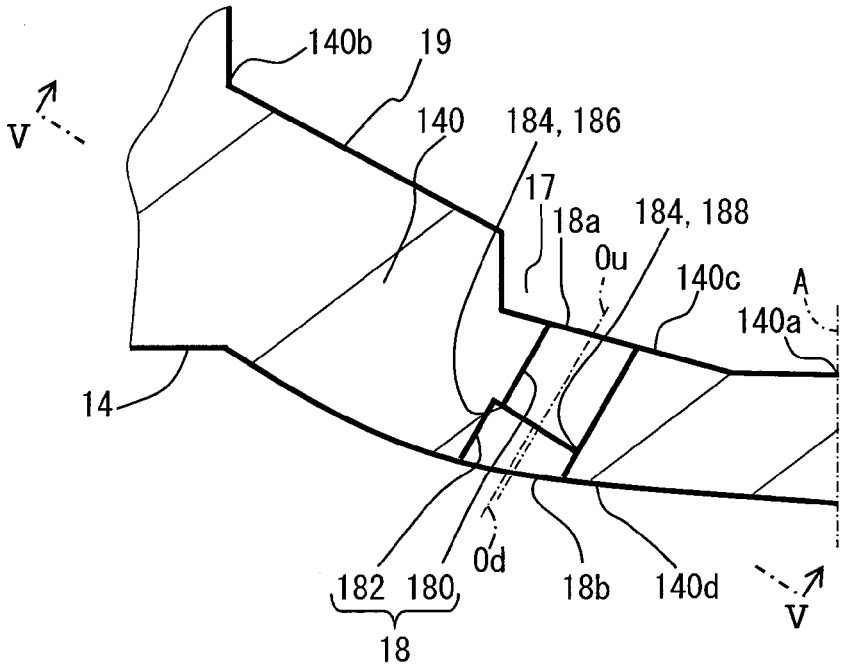
FIG. 3 is a fragmentally sectional view showing a fuel injection port taken along a line III-III in FIG. 2.

As shown in FIGS. 1 to 3, six fuel-injection ports 18 penetrate a circular-shaped nozzle-bottom portion 140 of the valve nozzle 14. As shown in FIGS. 2 and 3, each of the fuel-injection ports 18 is arranged around an axial line "A" passing through a center 140*a* of the nozzle-bottom portion 140. Each fuel-injection port 18 has a fuel-inlet 18*a* and a fuel-outlet 18*b*. Each fuel-injection port 18 is inclined with respect to the axial line "A" in such a manner that the fuel-outlet 18*b* is positioned close to an outer periphery 140*b* of the nozzle-bottom portion 140 more than the fuel-inlet 18*a*. In the following description, the center 140*a* of the nozzle-bottom portion 140 will be referred to as the nozzle center 140*a*, and the outer periphery 140*b* of the nozzle-bottom portion 140 will be referred to the nozzle periphery 140*b*.

Figure 4:
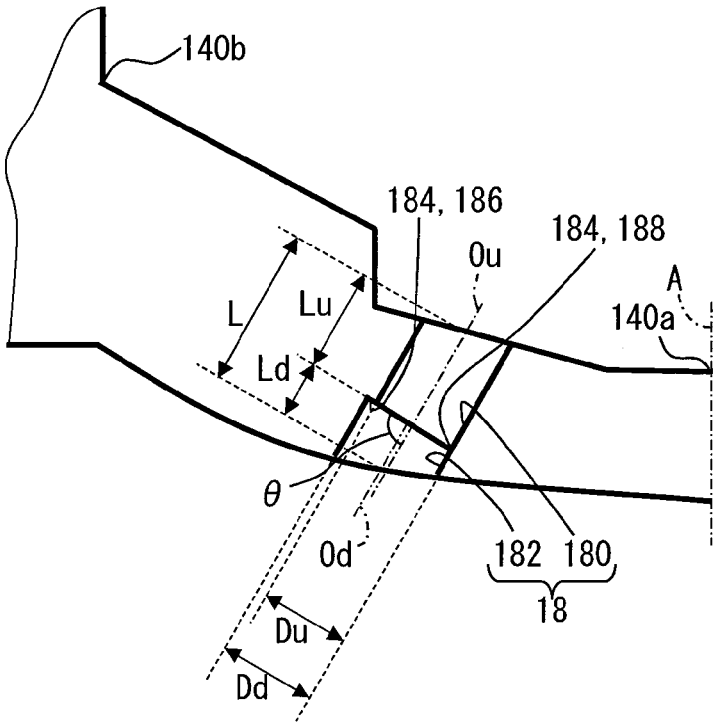
FIG. 4 is a schematic chart for indicating a length and an angle of a fuel injection port.
Figure 5:
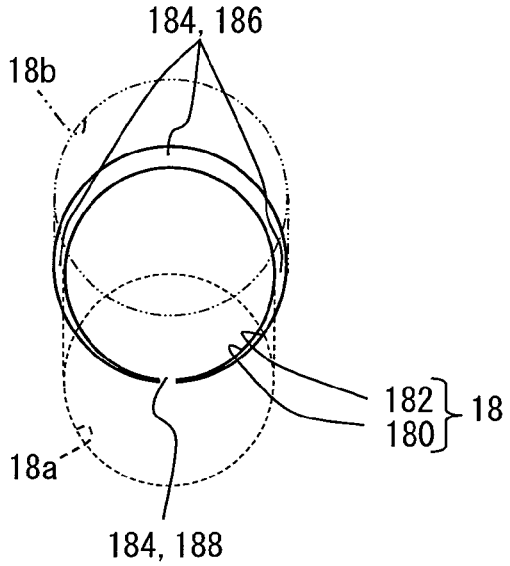
FIG. 5 is an enlarged view of the fuel injection port, which corresponds to a cross-sectional view taken along a line V-V in FIG. 3.

The fuel-injection port 18 has an upstream-portion 180 and a downstream-portion 182. The upstream-portion 180 defines the fuel-inlet 18*a*, and the downstream-portion 182*a* defines the fuel-outlet 18*b*. That is, the downstream-portion 182 is continuously formed downstream of the upstream-portion 180. As shown in FIGS. 3 and 4, a center line "Ou" passing through a center of the upstream-portion 180 and a center line "Od" passing through a center of the downstream-portion 182 are inclined toward the nozzle periphery 140*b* along a fuel-injecting direction. Especially, according to the present embodiment, the center line "Ou" and the center line "Od" are inclined on a common plane including the axial line "A". Thus, the fuel-injection port 18 is inclined as a whole relative to the axial line "A". Moreover, as shown in FIG. 4, on the center line "Ou", an axial length "Lu" of the upstream-portion 180 is longer than an axial length "Ld" of the downstream-portion 182.

As shown in FIGS. 2 and 3, the fuel-inlet 18*a* of the upstream-portion 180 on a surface 140*c* of the nozzle-bottom portion 140 is positioned close to the nozzle center 140*a* more than the valve seat 19. Thus, when the fuel injector 1 is opened, the fuel flows into the fuel-inlet 18*a* from the nozzle periphery 140*b* through a clearance between the seat portion 48 and the valve seats 19. Then, the fuel flows toward the downstream-portion 182 through the upstream-portion 180. According to the present embodiment, the upstream-portion 180 is a straight passage of which cross section is a circle constantly from the fuel-inlet 18*a* to a boundary 184 between the upstream-portion 180 and the downstream-portion 182.

The fuel-outlet 18*b* of the downstream-portion 182 on the other surface 140*d* of the nozzle-bottom portion 140 is positioned close to the nozzle periphery 140*b* relative to the fuel-inlet 18*a*. The other surface 140*d* of the nozzle-bottom portion 140 confronts to the combustion chamber (not shown) of the engine. When the fuel injector 1 is opened, the fuel flows through the upstream-portion 180 and the downstream-portion 182 to be injected from the fuel-outlet 18*b* into the combustion chamber properly. According to the present embodiment, the downstream-portion 182 is a straight passage of which cross section is a circle constantly from the boundary 184 to the fuel-outlet 18*b*.

As shown in FIG. 4, an inner diameter "Dd" of the downstream-portion 182 is larger than an inner diameter "Du" of the upstream-portion 180. At a cross section most close to the nozzle center 140*a*, the downstream-portion 182 and the upstream-portion 180 are connected smoothly. At a cross section close to the nozzle periphery 140*b*, the downstream-portion 182 is offset most relative to the upstream-portion 180. Since the center line "Ou" and the center line "Od" are eccentric to each other, a step surface 186 is defined between the downstream-portion 182 and the upstream-portion 180. The downstream-portion 182 and the upstream-portion 180 are connected smoothly at a connecting portion 188. Thereby, the step surface 186 is formed in approximately C-shaped at the boundary 184. Furthermore, the step surface 186 and the center line "Ou" cross each other at an angle θ. According to the present embodiment, the angle θ is substantially right angles (substantially 90°).

Figure 6:
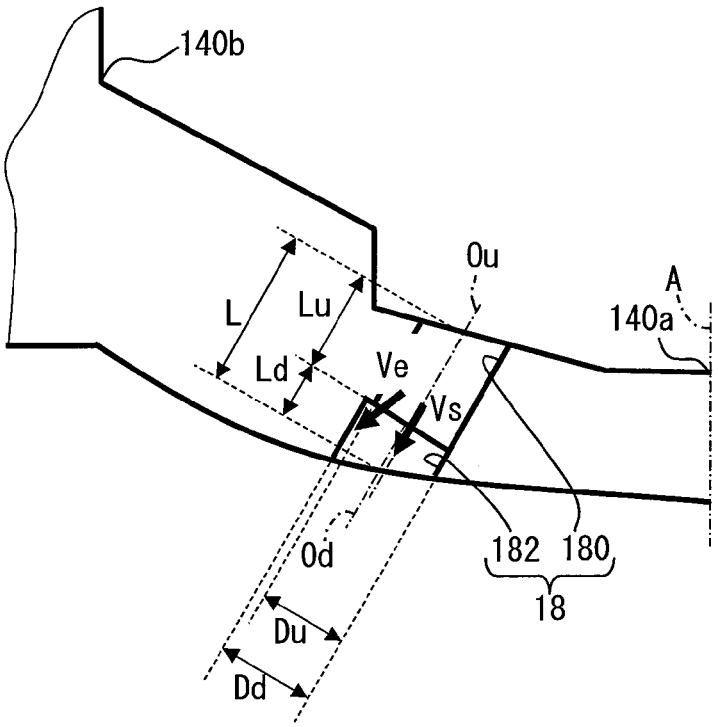
FIG. 6 is a schematic chart for indicating a length and a velocity vector of the fuel injection port.

In order to optimize the fuel flow flowing from the upstream-portion 180 to the downstream-portion 182, two kinds of velocity vectors "Vs" and "Ve" are defined in FIG. 6. Specifically, a straight vector "Vs" is a velocity vector that indicates a fuel flow flowing from the upstream-portion 180 to the downstream-portion 182 along the center line "Ou". An expansion vector "Ve" is a velocity vector that indicates a fuel flow flowing from the upstream-portion 180 to the downstream-portion 182 in a direction toward the nozzle periphery 140 relative to the center line "Ou". According to the present embodiment, the ratio between the inner diameter "Dd" of the downstream-portion 182 and the inner diameter "Du" of the upstream-portion 180 is defined in such a manner that the expansion vector "Ve" is smaller than the straight vector "Vs". For example, the ratio Dd/Du is 1.1 to 1.5. An axial length "L" of the fuel-injection port 18 is defined as "Lu"+ "Ld". The ratio L/Du is 1.45 to 1.85.

Advantages

Advantages of the present embodiment will be described hereinafter.

The fuel-inlet 18*a* into which the fuel flows from the nozzle periphery 140 is formed at an opening end of the upstream-portion 180. The fuel-outlet 18*b* is formed at an opening end of the downstream-portion 182 that is continuously connected to the upstream-portion 180. The step surface 186 is formed between the downstream-portion 182 and the upstream-portion 180. The step surface 186 and the center line "Ou" cross each other at the right angles. Therefore, when the fuel flows from the upstream-portion 180 to the downstream-portion 182, the fuel is hardly attracted toward the step surface 186. It is restricted that a deposit of the fuel remains on the step surface 186. Without reducing the ratio Dd/Du, it can be expedited that the fuel becomes like thin film and an atomization of the fuel spray is improved.

Further, since the upstream-portion 180 and the downstream-portion 182 are eccentric to each other as described above, the fuel flow direction in the downstream-portion 182 is hardly varied relative to the fuel flow direction in the upstream-portion 180. Since a variation of a fuel spray direction from the fuel-outlet 18*b* is restricted, the directivity of the fuel spray can be improved.

Since the step surface 186 is formed between the upstream-portion 180 and the downstream-portion 182, the surface tension of the fuel flowing from the upstream-portion 180 to the downstream-portion 182 is kept low. Even in a case that the fuel flow velocity in the fuel-injection port 18 is low, it is restricted that the fuel is attracted to and adheres on the step surface 186. Thus, a generation of the fuel deposit on the step surface 186 can be avoided. The atomization of the fuel can be improved.

Furthermore, the upstream-portion 180 and the downstream-portion 182 are straight passages respectively. The upstream-portion 180 and the downstream-portion 182 are smoothly connected with each other at the point close to the nozzle center 140*a*. The inner diameter of the fuel-outlet 18*b* can be enlarged. Therefore, in a vicinity of the fuel-outlet 18*b*, a separating area where the fuel is separated from an inner surface can be enlarged. The atomization of the fuel can be further improved.

Furthermore, on the center line "Ou", the axial length of the upstream-portion 180 is longer than that of the downstream-portion 182. Thus, the fuel flows straight along an inner surface of the upstream-portion 180. The fuel flow direction is ensured in both of the upstream-portion 180 and the downstream-portion 182.

In addition, the step surface 186 crosses the center line "Ou" at right angles. The fuel is hardly attracted to the step surface 186. The step surface 186 can be easily formed between the upstream-portion 180 and the downstream-portion 182.

The ratio Dd/Du is defined in such a manner that the expansion vector "Ve" is smaller than the straight vector "Vs". The fuel flow toward the step surface 186 is decreased, so that the fuel hardly adhere on the step surface 186. The fuel deposit is less generated from the adhered fuel. The atomization of the fuel is further improved.

Other Embodiment

The present disclosure should not be limited to the above embodiment, but may be implemented in other ways without departing from the spirit of the disclosure.

As a first modification, the number of the fuel-injection port 18 may be other than six. As a second modification, an axial length of the upstream-portion 180 may be shorter than or equal to that of the downstream-portion 182 on the center line "Ou".

Figure 7:
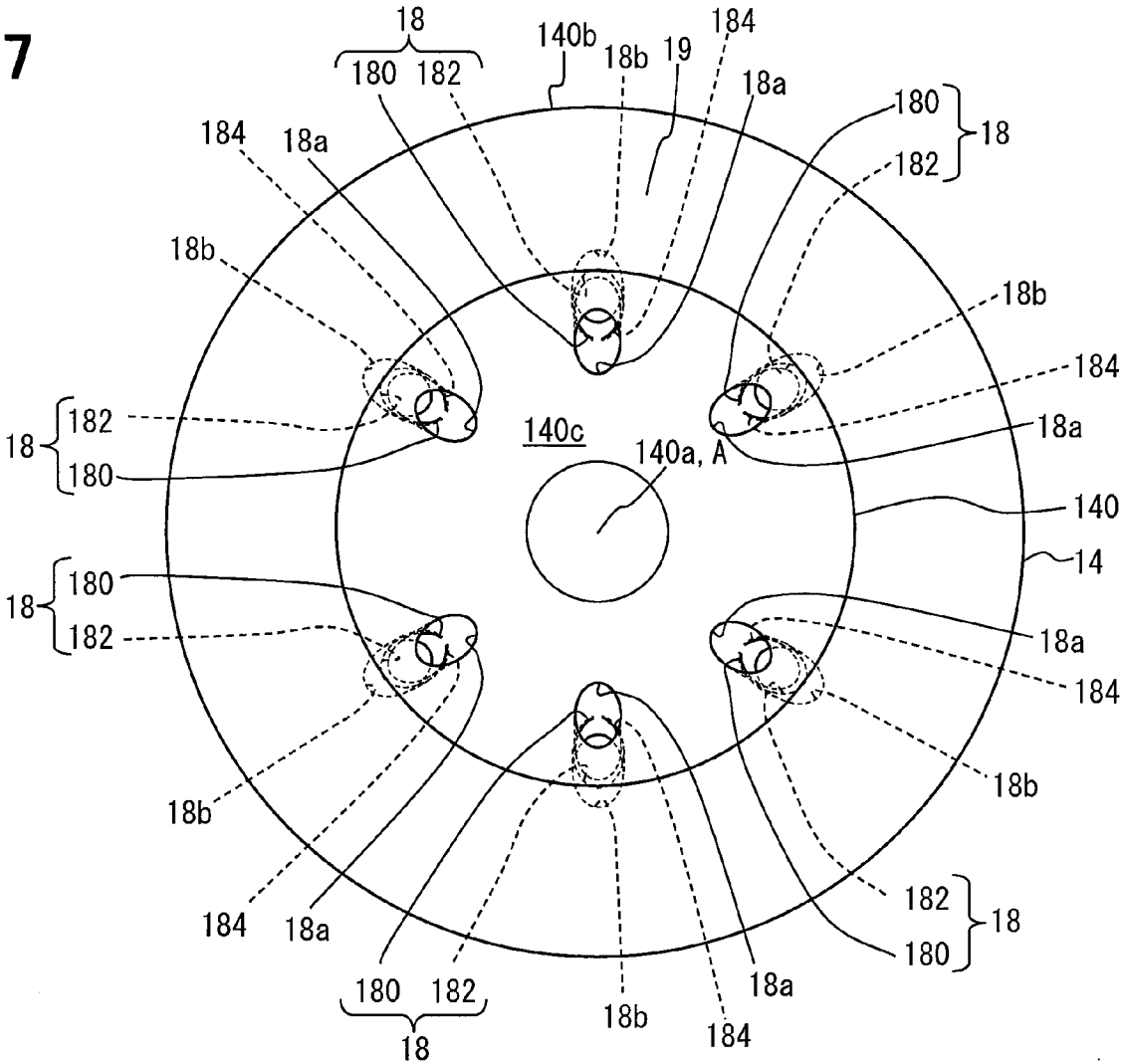
FIG. 7 is a chart showing a modification of FIG. 2.

As a third modification 3, at least one of the upstream-portion 180 and the downstream-portion 182 has an elliptical cross section. FIG. 7 shows the third modification in which both of the upstream-portion 180 and the downstream-portion 182 have the elliptical cross section.

Figure 8:
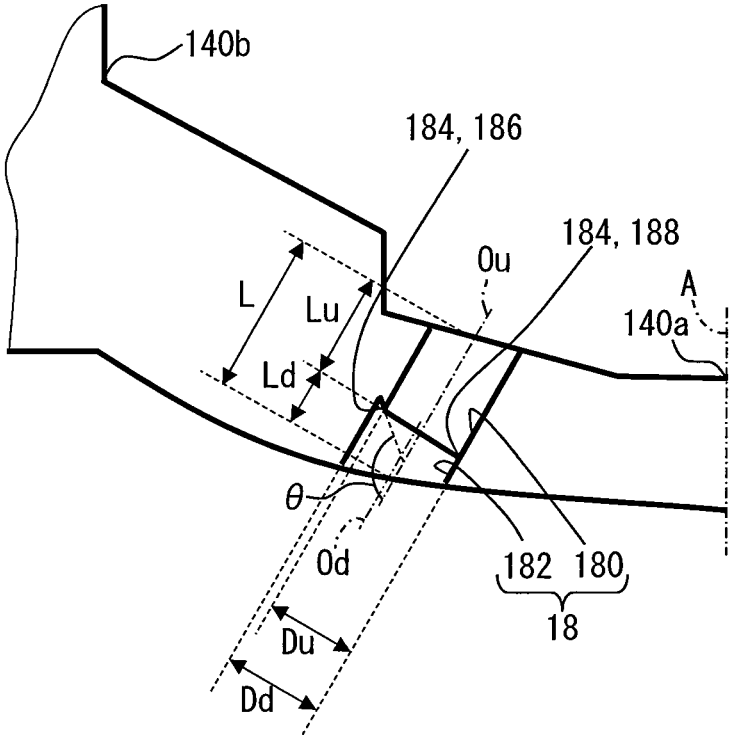
FIG. 8 is a chart showing a modification of FIG. 4.

As a fourth modification, the angle θ defined by the step surface 186 and the center line "Ou" may be obtuse angle, as shown in FIG. 8. Also in this case, the downstream-portion 182 is offset toward the nozzle periphery 140*b* relative to the upstream-portion 180.

As a fifth modification, the inner diameter of the upstream-portion 180 may be gradually decreased from the boundary 184 toward the fuel-inlet 18*a*. Also in this case, the upstream-portion 180 and the downstream-portion 182 are smoothly connected at a position most close to the nozzle center 140*a*.

As a sixth modification, the ratio Dd/Du may be defined in such a manner that the expansion vector "Ve" is greater than or equal to the straight vector "Vs".

As a seventh modification, the present disclosure may be applied to a part of the fuel-injection ports 18. The other fuel-injection ports 18 have another shape. As an eighth modification, the present disclosure may be applied to various type of fuel injectors, such as a fuel injector of which movable core 30 is fixed to the valve needle 40.

What is claimed is:

1. A fuel injector comprising:

a valve nozzle defining a fuel-injection port downstream of a fuel passage, the fuel-injection port being inclined toward a nozzle periphery from a fuel-inlet to a fuel-outlet; and a valve needle capable of moving in a valve-opening direction to open the fuel-injection port so that a fuel flowing into the fuel-inlet from the nozzle periphery is injected into an internal combustion engine; wherein the fuel-injection port has an upstream-portion defining the fuel-inlet, and a downstream-portion defining the fuel-outlet, the downstream-portion is smoothly connected to the upstream-portion at a position most close to a center of the valve nozzle, the downstream-portion is offset toward the nozzle periphery relative to the upstream-portion, so that the upstream-portion and the downstream-portion form a step surface therebetween, the step surface is eccentric to a center line of the upstream-portion, and an angle defined by the step surface and the center line is an obtuse angle.

2. A fuel injector according to claim 1, wherein the upstream-portion and the downstream-portion form the step surface continuously therebetween except a connecting portion which corresponds to the position most close to the center of the valve nozzle.

3. A fuel injector according to claim 1, wherein the upstream-portion is a straight passage which extends from a boundary between the upstream-portion and the downstream-portion to the fuel-inlet, and the downstream-portion is a straight passage which extends from the boundary to the fuel-outlet.

4. A fuel injector according to claim 1, wherein an axial length of the upstream-portion is longer than that of the downstream-portion on the center line.

5. A fuel injector according to claim 1, wherein a fuel velocity vector indicating a fuel flow flowing from the upstream-portion to the downstream-portion along the center line is defined as a straight vector, a fuel velocity vector indicating a fuel flow flowing from the upstream-portion to the downstream-portion in a direction toward the nozzle periphery relative to the center line is defined as an expansion vector, and a ratio between an inner diameter of the downstream-portion and an inner diameter of the upstream-portion is defined in such a manner that the expansion vector is smaller than the straight vector.

6. A fuel injector according to claim 1, wherein the downstream-portion is offset toward the nozzle periphery relative to the upstream-portion.

* * * * *